United States Patent [19]

Sak et al.

[11] Patent Number: 4,509,196

[45] Date of Patent: Apr. 2, 1985

[54] TAMPER-INDICATING SELF-SEALING POUCH

[75] Inventors: Dennis A. Sak, Hinsdale; Thomas Mestetsky, St. Charles; Stanley Manne, Glencoe, all of Ill.

[73] Assignee: Arvey Corporation, Chicago, Ill.

[21] Appl. No.: 509,861

[22] Filed: Jun. 30, 1983

[51] Int. Cl.[3] ..... B65D 33/20; B65D 77/12; B65D 33/34

[52] U.S. Cl. ..... 383/5; 206/438; 206/484; 206/807; 206/813; 229/48 SA; 383/89

[58] Field of Search ..... 206/438, 439, 484, 813, 206/807, 363; 229/80, 79, 81; 383/89, 5

[56] References Cited

U.S. PATENT DOCUMENTS

| | | | |
|---|---|---|---|
| 2,215,989 | 9/1940 | Wolf | 229/48 SA |
| 3,507,444 | 4/1970 | Werby | 229/80 |
| 3,625,351 | 12/1971 | Eisenberg | 206/484 |
| 3,675,844 | 7/1972 | Sorrell | 229/80 |
| 3,819,106 | 6/1974 | Schuster | 206/439 |
| 3,910,410 | 10/1975 | Shaw | 206/363 |
| 3,990,626 | 11/1976 | Goodrich . | |
| 3,991,881 | 11/1976 | Augurt | 206/439 |
| 4,194,622 | 3/1980 | Lewis | 206/363 |
| 4,276,982 | 7/1981 | Sibrava et al. | 206/439 |

OTHER PUBLICATIONS

Product Literature: *Scotch TM Joining Systems, R-70 Rubber Adhesive Family;* Sep. 1981; pp. 1-4; Industrial Specialties Division/3M, St. Paul, MN.

Product Literature: *Scotch TM Joining Systems Selection Guide;* Dec. 1981; pp. 1-6; Industrial Specialties Divison/3M, St. Paul, MN.

Product Literature: *Scotch TM Joining Systems, Adhesive Transfer Tapes;* pp. 1-2; Industrial Specialties Division/3M, St. Paul, MN.

*Primary Examiner*—William T. Dixson, Jr.

*Attorney, Agent, or Firm*—Dressler, Goldsmith, Shore, Sutker & Milnamow, Ltd.

[57] ABSTRACT

A tamper-indicating, self-sealing disposable pouch is disclosed which is readily adaptable for use for sterilization and sterility maintenance of medical articles and the like. The pouch includes first and second coextensive webs which are at least partially joined together to define the interior of the pouch. The pouch defines an access opening through which the contents of the pouch can be inserted therein, with the pouch uniquely including a laminate adhesive structure in association with the access opening for effecting closing and sealing thereof. The adhesive structure comprises an adhesive carrier member having first and second layers of adhesive on opposite surfaces thereof. The adhesive of the adhesive layers is selected to have an effective adhesive strength greater than the cohesive strength of the adhesive carrier member such that any attempt to reopen the access opening after it has been closed and sealed with the adhesive structure results in delamination of the adhesive structure for tamper-indication.

15 Claims, 6 Drawing Figures

TAMPER-INDICATING SELF-SEALING POUCH

CROSS-REFERENCE TO RELATED APPLICATION

The present disclosure is related to U.S. application Ser. No. 509,396, filed June 30, 1983.

TECHNICAL FIELD

The present invention relates generally to disposable self-sealing pouches, and more particularly to a self-sealing pouch having a laminate adhesive structure in association with the access opening of the pouch for effecting closing and sealing of the access opening, with the adhesive structure being adapted to delaminate for tamper-indication if the access opening is reopened.

BACKGROUND OF THE INVENTION

In hospitals and like health care facilities, it is routinely necessary to sterilize and maintain in a sterile condition a very large number of medical articles, such as surgical instruments and the like. In view of this, the use of disposable, self-sealing pouches has become increasingly widespread for convenient and efficient sterilization and sterility maintenance. The materials from which such pouches are fabricated can be readily selected to permit the pouches and their contents to be subjected to various types of sterilization processes, including steam, ethylene oxide gas, and radiation. Such self-sealing pouches can also be fabricated for non-sterilization uses. Commonly-assigned U.S. Pat. No. No. 4,276,982, to Sibrava et al., discloses one self-sealing sterilization pouch which has proven to be quite commercially successful.

Because it is vitally important that the sterility of medical articles in such pouches can be relied upon, it is extremely desirable for such pouches to be configured so as to provide a clear indication that they have been opened. Since such pouches are usually intended to be opened by pulling apart the pouch webs or by some other clearly visible permanent deformation of the pouch, it is desirable to provide some mechanism by which a visual indication is provided of any reopening of the pouch's access opening. Such tamper-indication assures that the access opening of the pouch has not been opened and then resealed, which of course could allow undesired contamination of the contents of the pouch.

The above Sibrava et al. patent teaches a self-seal pouch construction adapted to provide such tamper-indication. The pouch of this patent includes one pouch web of thermally stable plastic film, and a second pouch web of steam permeable paper, which may comprise paper or paper-like materials. To effect tamper-indication, the pressure-sensitive adhesive provided on the pouch for sealing its open end is selected so that reopening of the pouch's access opening after sterilization results in tearing or other visible deformation of the pouch's paper web.

While the above arrangement is quite effective, it does present some limitations in the materials from which the pouch can be fabricated since at least one of the pouch webs must be paper to provide the intended tamper-indication. Depending upon the intended use, it is sometimes desirable to provide a self-sealing pouch having webs both comprising plastic film. In some instances, the adhesive for sealing a self-sealing pouch can be selected to result in visible deformation of a plastic film web of the pouch, but this again presents limitations in the selection of materials since it can be desirable to fabricate a self-seal pouch from plastic film material having characteristics such that the film does not readily visually deform attendant to reopening of the pouch's access opening.

Accordingly, it is very desirable to provide a self-sealing pouch having a sealing arrangement which is adapted to provide tamper-indication without permanent deformation of one of the pouch's webs. By such an arrangement, greater flexibility is provided in the selection of materials from which the pouch webs can be formed, while visual tamper-indication is assured.

SUMMARY OF THE INVENTION

In accordance with the present invention, a tamper-indicating self-sealing pouch is disclosed which includes a laminate adhesive structure for effecting closing and sealing of the access opening of the pouch. The adhesive structure includes an adhesive carrier member, preferably comprising paper, having first and second adhesive layers on opposite sides thereof. By selecting adhesive having an effective adhesive strength and a cohesive strength greater than the cohesive strength of the adhesive carrier member, any attempt to reopen the access opening of the pouch results in visually discernible delamination of the adhesive structure for tamper indication. Additionally, the provision of the adhesive carrier member desirably acts to reinforce and stiffen the portion of the pouch which is folded for effecting sealing of the access opening, thus greatly facilitating convenient and proper sealing of the access opening.

The present self-sealing pouch comprises first and second generally rectangular, coextensive pouch webs which are at least partially marginally joined together to define the interior of the pouch. The pouch defines an access opening, which in the illustrated embodiment comprises a transversely extending opening slit defined by the first pouch web, but which may alternately comprise an unsealed end edge portion of one of the pouch webs.

The present pouch further includes a laminate adhesive sealing structure on the pouch in association with the access opening for closing and sealing the access opening. As noted, the laminate adhesive structure comprises an adhesive carrier member, preferably comprising paper, having first and second pressure-sensitive adhesive layers on opposite sides thereof. The first adhesive layer is adhered to at least one of the pouch webs for maintaining the laminate adhesive structure on the pouch, while the second adhesive layer is provided for effecting the closing and sealing of the access opening of the pouch.

In order to provide tamper-indication, the adhesive of the first and second adhesive layers is selected so that the effective adhesive strength and cohesive strength of the adhesive layers are greater than the internal or cohesive strength of the adhesive carrier member. Thus, if the access opening is opened after being closed and sealed with the second adhesive layer, the laminate adhesive structure visually delaminates to indicate opening by rupture or destruction of the adhesive carrier member.

In the illustrated embodiment of the present pouch, the transversely extending access opening slit of the pouch is defined by the first pouch web near one end thereof. The laminate adhesive structure is provided on the first pouch web such that it is positioned on opposite sides of, or flanks, the access opening slit. By this construction, the access slit can be closed and sealed by folding the pouch onto itself to bring the second adhesive layer into confronting relation with itself to effect closing and sealing of the access slit with an adhesive-to-adhesive seal. By this preferred configuration, convenient sealing of the pouch is facilitated since the access opening slit acts as a "natural" folding line for the pouch, with the resultant seal being easily formed, highly secure, and not dependent on an adhesive interface formed between the adhesive and a pouch web during closing and sealing.

In one illustrated embodiment, the laminate adhesive structure for the pouch is provided by a single strip of double-faced adhesive tape which defines an opening in alignment with the access opening slit of the pouch. Removable release paper is provided on the second adhesive layer of the adhesive structure to maintain the freshness thereof, with the release paper defining a further opening in alignment with the access opening slit. Thus, the contents of the pouch may be easily inserted through the release paper, the adhesive structure, and the access opening slit, and the release paper thereafter removed to permit sealing of the access opening slit with the second adhesive layer.

In an alternate embodiment, a pair of strips of double-faced adhesive tape are provided on respective opposite sides of the access opening slit of the pouch. In this arrangement, a removable release paper is provided on the second adhesive layer of each of the two adhesive strips, with the release papers being removable for sealing the pouch by bringing the two adhesive strips in a confronting relation with each other.

Notably, the provision of the adhesive carrier member desirably acts to stiffen and reinforce the portion of the pouch which is folded for effecting sealing. This has been found to greatly enhance the ease with which a proper seal of the access opening can be effected, a significant additional benefit of this tamper-indicating construction.

Further convenient use is facilitated by the provision of means for opening the pouch after it has been closed and sealed. In the preferred form, the pouch opening is accommodated by the provision of a tear notch on at least one of the joined together lateral edges of the pouch webs, with the pouch being easily grippable so it can be torn at the tear notch, with the tear propagating across the pouch webs for gaining access to its contents.

Numerous other features and advantages of the present pouch will become readily apparent from the following detailed description, the accompanying drawings, and the appended claims.

DETAILED DESCRIPTION

Figure 1:
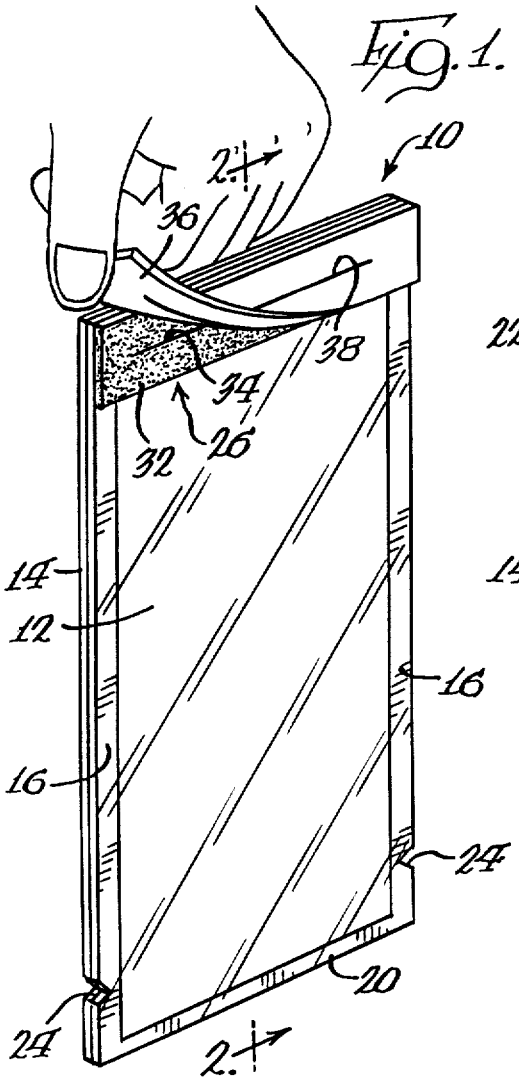
FIG. 1 is a perspective view of a self-sealing pouch embodying the principles of the present invention.

While the present invention is susceptible of embodiment in various forms, there is shown in the drawings and will hereinafter be described various embodiments of the invention, with the understanding that the present disclosure is to be considered as an exemplification of the invention, and is not intended to limit the invention to the specific embodiments illustrated.

It should be noted that for purposes of clarity of this disclosure, the constructions of the present invention illustrated in the accompanying drawings have not been drawn to scale. As will be recognized by those familiar with the art, the various components of the present pouch structure ordinarily have thicknesses on the order of a fraction of a mil to several mils. As will be further recognized, pouches formed in accordance with the teachings herein can be made in many different sizes.

Figure 2:
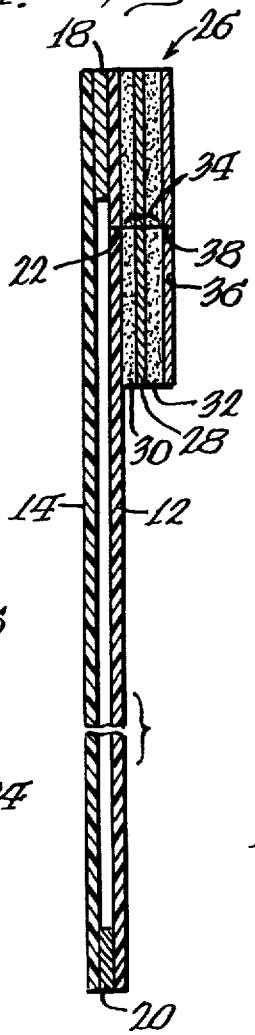
FIG. 2 is an enlarged cross-sectional view taken generally along lines 2—2 of FIG. 1.

With reference now to FIGS. 1 and 2, therein is illustrated a self-sealing pouch 10 embodying the principles of the present invention. The present pouch includes first and second coextensive pouch webs 12 and 14, which are preferably generally rectangular. The pouch webs are at least partially marginally joined together, and in the illustrated embodiment the pouch webs 12 and 14 are joined together along all of their marginal edge portions to define the interior of pouch 10 within which medical articles or the like can be inserted.

The method by which the webs of the present pouch are sealingly joined together can be appropriately effected in a number of ways. Depending upon the materials from which pouch webs 12 and 14 are formed, which are ordinarily selected with consideration of the intended pouch use, the present pouch may be formed either with or without the use of one or more adhesive layers between the pouch webs for sealingly joining the webs together. Such adhesive layers can be coated to one or both of the pouch webs before the webs are joined, as is well known in the art. In this regard, the joining of the webs can be effected with heat sealing, either in conjunction with adhesive material, or by direct heat-sealing of the pouch webs together without the use of adhesive. These various techniques are known, and the present pouch is readily adaptable for formation using a wide variety of techniques and materials.

In one presently preferred embodiment of the present pouch, each of the first and second pouch webs 12 and 14 comprise polyolefinic transparent plastic film, such as polyethylene, polypropylene or blends thereof. Other plastic films may also be employed, such as polyethylene terephthalate, nylon or a laminate of polyethylene terephthalate and polypropylene. Alternately, paper or paper-like material can be employed for one or both of pouch webs 12 and 14, such as surgical kraft paper, or synthetic or artificial paper-like material such as those comprising spun, bonded plastic fibers and the like. As noted, material selection is ordinarily dependent upon the intended use of the pouch since, for example, some materials are better suited than others for certain sterilization processes. Because the present pouch arrangement is readily adaptable for use with all types of sterilization processes including gas, radiation and steam sterilization, as well as being adaptable for non-sterilization use (such as sterility maintenance), the materials for the webs of the pouch can be appropriately selected for the intended use.

Figure 3:
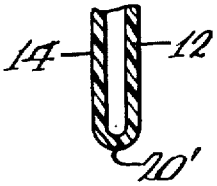
FIG. 3 is a cross-sectional view which illustrates a modified construction for the present pouch.

The marginal edge portions of first and second pouch webs 12 and 14 are joined together along side edge seals 16, end seal 18 (FIG. 2), and end seal 20 by heat-sealing. Alternately, the first and second pouch webs may be formed from a single piece of web material, and thus joined together at one end edge thereof at the fold 20' of the single piece of web material, as illustrated in FIG. 3. In such a construction, the remaining marginal edge portions of the first and second webs are joined together such as by heat sealing at seals 16 and 18.

In order to gain access to the interior of pouch 10 for insertion of articles therein, first pouch web 12 defines a preferably transversely extending access opening slit 22. The access opening slit preferably extends transversely of the pouch a distance less than the distance between side edge seals 16, and is preferably positioned just inwardly of end seal 18. As will be further described, the present pouch is adapted to be folded onto itself preferably generally about access slit 34, with the access slit providing a "natural" folding line for very conveniently effecting a seal thereof. If desired, a "pre-fold" for the pouch can be formed during its manufacture by folding the pouch at access slit 34 (or along a line spaced from the access slit if desired), and lightly heat sealing.

As will be recognized, access slit 34 may comprise a slot-like opening. Alternately, the access opening for the pouch can be provided by an unsealed end edge of the first pouch web 12, with the corresponding end of the second web 14 extending therebeyond to provide a sealing flap. The laminate adhesive structure provided in accordance with the present invention can then be positioned on the pouch in association with the access opening defined by the unsealed end edge of the first pouch web to effect closing and sealing of the access opening with the sealing flap.

The present pouch is preferably configured so as to deter opening of access slit 22 after it has been sealed. Therefore, in order to gain access to the interior of pouch 10 for removal of its contents, means are preferably provided apart from the access slit 22 for opening the pouch. The opening means preferably comprise one or more tear notches 24 defined by the joined together marginal side edge portions of the first and second pouch webs 12 and 14. The provision of one or more tear notches 24 facilitates convenient opening of the pouch after it has been sealed since the pouch can be easily gripped and torn at one of the tear notches 24, with the tear then propagating across the first and second pouch webs 12 and 14. For some pouch constructions, access to the pouch contents can be provided by formation of a chevron-shaped seal at the end of the pouch opposite its access opening, such as at end seal 20.

As discussed above, the access opening slit 22 of the pouch in the illustrated embodiment is adapted to be closed and sealed with an adhesive-to-adhesive seal formed between adhesive areas disposed along respective opposite sides of the access slit. As best illustrated in FIG. 2, this embodiment of the present pouch includes a laminate adhesive structure 26 for effecting sealing of access slit 22. The adhesive structure 26 comprises an adhesive carrier member 28, preferably comprising paper, and first and second pressure-sensitive adhesive layers 30 and 32 disposed on respective opposite sides of the carrier member 28. Adhesive structure 26 defines an opening 34 in alignment with access opening slit 22, thus flanking the access slit with adhesive. The access opening slit 22 is preferably disposed generally centrally of the adhesive structure 26, with the adhesive structure positioned about the access slit.

A removable release paper 36 is preferably provided on the second adhesive layer 32 for maintaining the freshness thereof, with the release paper 36 defining a further opening 38 aligned with opening 34 and access opening slit 22. By this construction, the adhesive structure 26 may comprise a single strip having release paper 36 affixed to its second adhesive layer 32, with this arrangement applied to first pouch web 12 during manufacture of the pouch with first adhesive layer 30. Appropriate cutting means can then be employed to simultaneously form opening 38, opening 36, and access opening slit 22. The pouch webs 12 and 14 can then be joined together, with heat sealing or like formation of end seal 18 being effected through a portion of the release paper 36 and adhesive structure 26.

The adhesive structure 26 preferably comprises a double-faced, pressure-sensitive adhesive tape, such as Scotch TM adhesive transfer tape R-70, No. 464, marketed by 3M Industrial Specialities Division, St. Paul, Minn. In one current embodiment of the invention, a double-faced adhesive tape having an adhesive width of 0.75 inches has been used.

Significantly, the disclosed adhesive structure is adapted to provide tamper-indication (i.e., visual evidence of opening or attempted opening) in the event that access opening slit 22 is opened after sealing thereof. Specifically, the laminate adhesive structure 26 is configured such that the effective adhesive strength and cohesive strength of each of first and second adhesive layers 30 and 32 is greater than the cohesive strength of adhesive carrier member 28.

Thus, after open access slit 22 has been sealed with adhesive structure 26 and the adhesive of layer 32 has sufficiently set or cured (usually within several minutes of sealing, depending upon the quantity and type of adhesive, the sealing pressure, and temperature), any attempt to open the access slit results in delamination of the adhesive structure by rupture or destruction of carrier member 28, thereby providing a clear, visually discernible indication of tampering. As will be recognized, this desired tamper-indication is not dependent upon any deformation of the pouch webs themselves. Additionally, formation of the pouch from transparent plastic film material facilitates visual inspection of the seal formed with adhesive structure 26.

As noted, first adhesive layer 30 is adapted to secure adhesive structure 26 to first pouch 12 of pouch 10. In this regard, it can be desirable to subject the portion of the pouch which receives the adhesive structure 26 to corona discharge treatment shortly before adhesive structure 26 is affixed to the pouch with adhesive layer 30. Such treatment is particularly desirable when the pouch web to which the adhesive structure is affixed comprises polyolefin plastic film. Since the closing seal of the illustrated pouch is effected with an adhesive-to-adhesive interface, the pouch's useful shelf life is not dependent upon the freshness of any such corona discharge treatment.

In addition to providing tamper-indication, the provision of laminate adhesive structure 26 facilitates convenient and proper closing of the pouch 10. The adhesive carrier member 28, which as noted preferably comprises paper, desirably acts as a reinforcing member which stiffens the portion of pouch 10 folded onto itself, thus facilitating convenient manipulation for closing. This reinforcing or rigidification by the member 28 is particularly desirable when the pouch webs 12 and 14 comprise plastic film material since such material is usually flexible and non-rigid. This added benefit of the tamper-indicating laminate adhesive structure is significant in view of the importance of properly closing and sealing the present pouch when configured for sterilization or sterility maintenance use.

Figure 4:
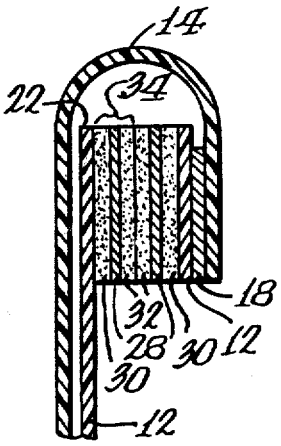
FIG. 4 is a cross-sectional view which illustrates the pouch of FIGS. 1 and 2 after it has been folded onto itself for sealing.

Closing and sealing of access opening slit 22 with laminate adhesive structure 26 is illustrated in FIG. 4. In this figure, pouch 10 is illustrated as folded onto itself about the natural folding line defined by access opening slit 22. This fold is effected after the contents of the pouch have been inserted therein, and release paper 36 removed. As is evident in FIG. 4, the adhesive-to-adhesive closing seal for the pouch is effected between the confronting surfaces of second adhesive layer 32, which is brought into confronting relation with itself when the pouch is folded. Because the adhesive of layers 30 and 32 is selected to have an effective adhesive strength and cohesive strength greater than the cohesive strength of adhesive carrier member 28, any attempts to gain access to the interior of the pouch via the sealed access slit 22 results in rupture of the adhesive carrier member 28, causing the adhesive structure to delaminate and thus clearly indicate tampering.

Figure 5:
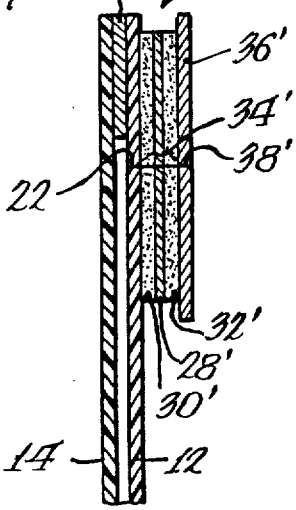
FIG. 5 is a cross-sectional view similar to FIG. 2 illustrating a further modification of the pouch illustrated in FIGS. 1 and 2.

FIG. 5 illustrates a modification of the above-described laminate adhesive structure and associated release paper. In FIG. 5, a laminate adhesive structure 26' is provided, including an adhesive carrier member 28', and first and second pressure-sensitive adhesive layers 30' and 32'. The adhesive structure 26 defines an opening 34' aligned with access opening slit 22 defined by first pouch web 12. In this modified form, a removable release paper 36' is provided on the surface of second adhesive layer 32', with the release paper 36' defining a further opening 38' in alignment with access opening slit 22 and opening 34 in the adhesive structure. Notably, the laminate adhesive structure 26' and release paper 36' are dimensioned with respect to each other such that the release paper 36' is larger than the laminate adhesive structure 26'. By this construction, convenient removal of the release paper 36' is facilitated. For this type of adhesive construction, Scotch TM extended liner adhesive transfer tape R-70, No. 464XL, can be employed. Such a tape has an adhesive width of 0.75 inches, with a release paper of a 1.0 inch width.

Figure 6:
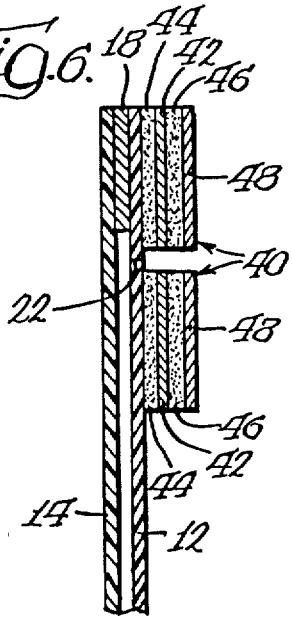
FIG. 6 is a cross-sectional view illustrating an alternate embodiment of the present invention.

Referring now to FIG. 6, an alternate embodiment of the present self-sealing pouch is disclosed. In this embodiment the arrangement for sealing the access opening slit 22 in first web 12 is provided by a pair of laminate adhesive structures 40 positioned on respective opposite sides of the access opening slit 22 on first web 12. Each laminate adhesive structure 40 can be appropriately provided by a strip of double-faced tape as described above, and thus each adhesive structure includes an adhesive carrier member 42 (preferably paper), and first and second pressure-sensitive adhesive layers 44 and 46 disposed on respective opposite sides of the adhesive carrier members 42. In this embodiment, closing and sealing of access opening slit 22 is effected by removing a release paper 48 provided on each of the second adhesive layers 42 of the laminate adhesive structures 40, with the pouch then folded onto itself so that the second adhesive layers 46 are brought into confronting relation to close the pouch with an adhesive-to-adhesive seal.

Thus, a unique tamper-indicating self-sealing pouch construction is disclosed which not only facilitates visual inspection of the integrity of the closing seal of the pouch, but which also facilitates convenient and efficient formation of the closing seal. While the present invention has been disclosed by illustrated embodiments including an access opening defined by the first of the pouch webs with the laminate adhesive structure of the invention affixed to the first pouch web, it will be appreciated that the teachings herein are applicable for forming tamper-indicating self-sealing pouches of many different configurations.

As will be recognized from the foregoing, numerous variations and modifications may be effected without departing from the true spirit and scope of the concept of the present invention. It will be understood that no limitation with respect to the specific constructions illustrated herein is intended or should be inferred. It is, of course, intended to cover by the appended claims all such modifications as fall within the scope of the claims.

What is claimed is:

1. A tamper-indicating, self-sealing pouch, comprising:

first and second generally coextensive webs at least partially marginally joined together to define the interior of said pouch;

access opening means defined by said pouch for providing access to the interior of said pouch comprising an elongated access opening defined by said first pouch web; and laminate adhesive sealing means on said pouch in association with said opening means for closing and sealing said access opening means, said adhesive sealing means comprising a laminate of adhesive carrier means having first and second adhesive means on opposite sides thereof, said first adhesive means being adhered to said first of said pouch webs for maintaining said laminate adhesive means on said pouch, and said second adhesive means being adapted to effect the closing and sealing of said access opening means such that if said access opening means is opened after being closed and sealed by said second adhesive means, said laminate adhesive means delaminates to indicate opening;

said laminate adhesive means being positioned on said first web on opposite sides of said access opening such that said pouch can be folded to bring said second adhesive means into confronting relation with itself to effect closing and sealing of said access opening with an adhesive-to-adhesive seal.

2. A tamper-indicating, self-sealing pouch in accordance with claim 1, wherein the effective adhesive strength of each of said first and second adhesive means is greater than the cohesive strength of said adhesive carrier means, whereby said laminate adhesive means is adapted to delaminate by rupture of said adhesive carrier means.

3. A tamper-indicating, self-sealing pouch in accordance with claim 2, wherein said adhesive carrier means comprises paper, and each of said first and second adhesive means comprises a pressure-sensitive adhesive.

4. A tamper-indicating, self-sealing pouch in accordance with claim 1, including means apart from said access opening for opening said pouch after said access opening is closed and sealed by said second adhesive means.

5. A tamper-indicating, self-sealing pouch in accordance with claim 1, wherein said first and second pouch webs are each generally rectangular and each comprises plastic film, the opposite lateral marginal edges of said first and second webs being joined together by heat seal means, said access opening extending transversely of said first web generally adjacent one end of said pouch.

6. A tamper-indicating, self-sealing pouch in accordance with claim 5, including means for opening said pouch after said access opening has been closed and sealed by said second adhesive means comprising a tear notch defined by said first and second webs on at least one marginal edge of said pouch intermediate the ends thereof.

7. A tamper-indicating self-sealing pouch in accordance with claim 1, wherein said adhesive carrier means comprises a paper member, said first and second adhesive means respectively comprising first and second pressure-sensitive adhesive layers on opposite surfaces of said paper member, said first adhesive layer adhesively affixing said laminate adhesive means to said first pouch web, and said second adhesive layer being adapted to seal and close said access opening, said laminate adhesive means defining another opening in alignment with said access opening such that said laminate adhesive means is positioned about and adjacent to said access opening and said access opening is accessible through said laminate adhesive means prior to sealing of said access opening.

8. A tamper-indicating, self-sealing pouch in accordance with claim 7, including removable release paper means covering said second adhesive layer, said release paper means defining a further opening in alignment with said access opening.

9. A tamper-indicating, self-sealing pouch in accordance with claim 1, wherein said laminate adhesive means comprises a pair of laminate adhesive structures positioned on said first pouch web on respective opposite sides of said access slit, each said laminate adhesive structure including said adhesive carrier means and said first and second adhesive means on opposite sides of the respective carrier means such that said access slit can be closed and sealed by folding said pouch to bring the second adhesive means of said laminate adhesive structures into confronting relation with each other.

10. A tamper-indicating, self-sealing pouch, comprising:

first and second rectangular, generally coextensive plastic film webs joined together along all of the marginal edge portions thereof to define the interior of said pouch;

access slit means defined by said first web, generally adjacent one end thereof for providing access to the interior of said pouch, said access slit means extending generally transversely of said pouch; and laminate adhesive means positioned on said first web about said access slit means, said laminate adhesive means comprising a paper adhesive carrier member having first and second pressure-sensitive adhesive layers on opposite sides thereof, said first adhesive layer adhesively affixing said laminate adhesive means to said first web, said laminate adhesive means being adapted to close and seal said access slit means by folding said pouch to bring said second pressure-sensitive adhesive layer into confronting relation with itself to seal said access slit means with an adhesive-to-adhesive seal;

said paper adhesive carrier having a cohesive strength less than the effective adhesive strength of each of said first and second pressure-sensitive adhesive layers so that said laminate adhesive means is adapted to delaminate by rupture of said paper carrier if said access slit means is opened after the slit means have been sealed with said second pressure-sensitive adhesive layer.

11. A tamper-indicating, self-sealing pouch in accordance with claim 10, including removable release paper means for covering said second pressure-sensitive adhesive layer, said release paper means defining an opening in alignment with said access slit means.

12. A tamper-indicating self-sealing pouch in accordance with claim 11, including means for opening said pouch after said access slit means has been sealed by said second pressure-sensitive adhesive means comprising a tear notch defined by said first and second pouch webs on at least one of the lateral marginal edges of said pouch.

13. A tamper-indicating, self-sealing pouch in accordance with claim 12, wherein said first and second pouch webs comprise a single piece of plastic film material folded onto itself to provide said generally coextensive first and second pouch webs.

14. A tamper-indicating, self-sealing pouch, comprising:

first and second generally coextensive, rectangular pouch webs at least partially marginally joined together to define the interior of said pouch;

access opening means defined by said pouch generally adjacent one end thereof for providing access to the interior of said pouch for insertion of an article therein;

laminate adhesive sealing means affixed to said pouch in association with said access opening means for closing and sealing said opening means, said laminate adhesive means comprising a paper adhesive carrier member and first and second layers of pressure-sensitive adhesive disposed on respective opposite sides of said adhesive carrier member, said first adhesive layer affixing said laminate adhesive means to said pouch, and said second adhesive layer being adapted to close and seal said access opening means when said pouch is folded onto itself, said first and second adhesive layers comprising adhesive having an effective adhesive strength greater than the cohesive strength of said adhesive carrier member so that opening of said access opening means after it has been closed and sealed results in delamination of said laminate adhesive structure by rupture of said adhesive carrier member to indicate tampering; and means apart from said access opening means for opening said pouch after said access opening means have been closed and sealed.

15. A tamper-indicating, self-sealing pouch in accordance with claim 14, wherein said first and second pouch webs each comprise transparent plastic film, said opening means apart from said access opening means comprising a tear notch defined by the joined together respective lateral edge portions of said first and second plastic film pouch webs.

* * * * *

UNITED STATES PATENT AND TRADEMARK OFFICE

CERTIFICATE OF CORRECTION

PATENT NO. : 4,509,196

DATED : April 2, 1985

INVENTOR(S) : Dennis A. Sak, Thomas Mestetsky, Stanley Manne

It is certified that error appears in the above-identified patent and that said Letters Patent is hereby corrected as shown below:

In column 9, line 42, the word "slit" should be --opening--.
line 45, the word "slit" should be --opening--.

Signed and Sealed this

*Tenth* Day of *September 1985*

[SEAL]

*Attest:*

DONALD J. QUIGG

*Attesting Officer* *Acting Commissioner of Patents and Trademarks - Designate*